US008220510B2

(12) United States Patent
Armstrong et al.

(10) Patent No.: US 8,220,510 B2
(45) Date of Patent: Jul. 17, 2012

(54) CARRYING BAG SYSTEMS AND METHODS WITH REVERSIBLE FLAP

(75) Inventors: F. Scott Armstrong, Seattle, WA (US); Gary D. Hubbert, Marysville, WA (US)

(73) Assignee: Fairhaven Group, Inc., Bellingham, WA (US)

( * ) Notice: Subject to any disclaimer, the term of this patent is extended or adjusted under 35 U.S.C. 154(b) by 822 days.

(21) Appl. No.: 12/356,133

(22) Filed: Jan. 20, 2009

(65) Prior Publication Data

US 2010/0078099 A1 Apr. 1, 2010

Related U.S. Application Data

(60) Provisional application No. 61/101,181, filed on Sep. 30, 2008.

(51) Int. Cl.
*A45F 3/04* (2006.01)

(52) U.S. Cl. ..... 150/105; 150/103; 150/104; 150/111; 383/37; 383/38; 206/315.11; 206/315.4; 224/153; 224/155; D3/233; D3/246

(58) Field of Classification Search ..... 150/105, 150/100, 103, 104, 111; 383/37, 38; 206/315.11, 206/315.4; 224/153, 155; D3/233, 246
See application file for complete search history.

(56) References Cited

U.S. PATENT DOCUMENTS

| | | | | |
|---|---|---|---|---|
| 1,562,408 | A | 11/1925 | Berkowitz | |
| 1,747,801 | A | 2/1930 | Topal | |
| 2,080,453 | A | 5/1937 | Kraut | |
| 2,784,756 | A | 3/1957 | Resnick | |
| 2,798,524 | A | 7/1957 | Ryon | |
| 3,182,701 | A | 5/1965 | Ginsburg | |
| 3,556,187 | A | 1/1971 | Speakes | |
| 4,648,121 | A * | 3/1987 | Lowe | 383/76 |
| 5,009,319 | A | 4/1991 | Jantzen | |
| 5,503,204 | A | 4/1996 | Byers et al. | |
| 5,603,573 | A * | 2/1997 | Mercier et al. | 383/117 |
| 5,649,581 | A | 7/1997 | Kopel | |
| 5,934,527 | A * | 8/1999 | Von Neumann | 224/153 |
| 6,129,126 | A | 10/2000 | Restivo | |
| 6,820,664 | B1 * | 11/2004 | Ritch | 150/103 |
| 2004/0050468 | A1 | 3/2004 | Powers | |
| 2005/0067246 | A1 | 3/2005 | Teicher et al. | |
| 2005/0103410 | A1 | 5/2005 | Dittrich et al. | |
| 2006/0021684 | A1 * | 2/2006 | DeCoro | 150/105 |
| 2009/0194541 | A1 * | 8/2009 | Mayo | 220/495.06 |
| 2011/0108550 | A1 * | 5/2011 | Vines | 220/23.86 |

* cited by examiner

*Primary Examiner* — Anthony Stashick
*Assistant Examiner* — Cynthia Collado
(74) *Attorney, Agent, or Firm* — Seed IP Law Group PLLC

(57) ABSTRACT

A carrying bag assembly comprises a bag assembly, a flap, and a first connection system. The bag assembly comprises a front panel, a rear panel, a left side panel, a right side panel, a bottom panel, and a cover panel. The bag assembly defines a bag opening and a connection pocket. The flap defines first and second flap surfaces. The flap may be in one of a first attached configuration, a second attached configuration, and a detached configuration. When in either of the first and second attached configurations, the flap may be moved between a closed configuration and an open configuration. When in one of the attached configurations, either the first or second flap surface is visible when the flap is in the closed configuration. When the flap is in either of the first or the second attached configurations, the first connection system is substantially located within the connection pocket.

20 Claims, 8 Drawing Sheets

CARRYING BAG SYSTEMS AND METHODS WITH REVERSIBLE FLAP

RELATED APPLICATIONS

This application claims benefit of U.S. Provisional Patent Application Ser. No. 61/101,181 filed Sep. 30, 2008.

The subject matter of the foregoing related application is incorporated herein by reference.

TECHNICAL FIELD

The present invention relates to reconfigurable carrying bags and, more specifically, to carrying bags that are reconfigurable to alter an aesthetic look of the bag.

BACKGROUND

The term "carrying bag" will be used herein to refer to any mercantile soft good adapted to be hung from a person and to carry one or more other items. Examples of carrying bags include purses, messenger bags, backpacks, and computer bags.

A carrying bag is often used in both business and social settings, and the aesthetic look of the bag should be appropriate for both settings. Typically, carrying bags have been designed with a more sedate look that is acceptable in a business setting, although a more sedate look may not be what the user desires in a social setting.

The need thus exists for carrying bags that may be reconfigured for use in both business settings and social settings.

RELATED ART

The following references were uncovered during a professional patentability search conducted on behalf of the Applicants.

U.S. Pat. No. 1,747,801 to Topal and U.S. Pat. No. 2,080,453 to Kraut both disclose a bag or purse having a flap that is detachably attached to an upper edge of the bag or purse adjacent to an opening defined by the bag or purse. The flap is detachably attached to the bag or purse using snap fasteners. In one configuration, a first side of the flap is exposed. In a second configuration, a second side of the flap is exposed.

U.S. Pat. No. 1,562,408 to Berkowitz discloses a hand bag having a flap connected along a bottom edge of a first side of the bag. The flap covers an opening in the hand bag. The flap rotates relative to the bag from a first position in which one side of the flap is exposed and a second position in which a second side of the flap is exposed. In the first position, the flap extends up the first side of the bag and over the opening. In the second position, the flap extends under the bottom of the bag, along a second side of the bag, and over the opening.

U.S. Pat. No. 2,784,756 to Resnick discloses a handbag having a flap that is detachably attached adjacent to lower edges of the handbag. The flap extends from the lower edges over an opening defined by the handbag. The flap is detachably attached to the bag or purse using clasps and grommets. In one configuration, a first side of the flap is exposed. In a second configuration, a second side of the flap is exposed.

U.S. Pat. No. 2,798,524 to Ryon discloses a hand bag having a flap connected along a bottom surface of the bag. The flap covers an opening in the hand bag. The flap rotates relative to the bag from a first position in which one side of the flap is exposed and a second position in which a second side of the flap is exposed. In the first position, the flap extends up a first side of the bag and over the opening. In the second position, the flap extends up a second side of the bag and over the opening.

U.S. Pat. No. 3,182,701 to Ginsburg discloses a hand bag having a panel that extends around a bottom surface of the bag and up first and second sides of the bag. The panel is detachably attached along upper edges of the first and second sides. The panel may be attached to the bag in a first position in which one side of the flap is exposed and a second position in which a second side of the flap is exposed.

U.S. Pat. No. 3,556,187 to Speakes discloses a hand bag having side walls that are covered by a clear panel. Decorative panels are inserted between the sidewalls and the clear panels and are visible through the clear panels.

U.S. Pat. No. 5,009,319 to Jantzen discloses a purse having a resilient sheet arranged to define the shape of a fabric body. Quick-connect means are used to detachably attach flaps to the fabric body.

U.S. Pat. No. 5,503,204 to Byers et al. discloses a handbag having a flap that is detachably attached adjacent to lower edges of the handbag. The flap extends from the lower edges over an opening defined by the handbag. The flap is detachably attached to the bag or purse using spring-loaded clasp and grommet. In one configuration, a first side of the flap is exposed. In a second configuration, a second side of the flap is exposed.

U.S. Pat. No. 5,649,581 to Kopel discloses a bag or purse having a flap that is rotatably attached to an upper edge of the bag or purse adjacent to an opening defined by the bag or purse. The flap may be rotated between a first configuration in which a first side of the flap is exposed and a second configuration in which a second side of the flap is exposed.

U.S. Pat. No. 6,129,126 to Restivo discloses a hand bag having a interchangeable decorative panels. Flaps are connected along upper edges of the bag. A decorative panel is connected to the flaps and extends down the sides and along the bottom of the bag. The decorative panel may be removed and replaced with a similar panel or may be removed and reversed to display a different graphic.

U.S. Pat. No. 5,649,581 to Kopel discloses a bag or purse having one or more flaps rotatably attached by rails to an upper edge of the bag or purse adjacent to an opening defined by the bag or purse. The flap or flaps may be rotated between a first configuration in which a first side of the flap is exposed and a second configuration in which a second side of the flap is exposed.

U.S. Patent Application No. 2004/0050468 to Teicher et al. discloses a carrying case that employs a hook and loop fastener to detachably attach a decorative overlay to a front panel of the carrying case.

U.S. Patent Application No. 2005/0067246 to Teicher et al. discloses a carrying case that employs a hook and loop fastener to detachably attach a decorative overlay to a front panel of the carrying case.

U.S. Patent Application No. 2005/0103410 to Dittrich discloses a hand bag having a flap connected along a top surface of the bag. The flap covers openings in the hand bag. The flap rotates relative to the bag from a first position in which the flap overlies one side of the bag and a first side of the flap is exposed and a second position in which the flap overlies a second side of the bag and a second side of the flap is exposed.

SUMMARY

The present invention may be embodied as a carrying bag assembly comprising a bag assembly, a flap, and a first connection system. The bag assembly comprises a front panel, a rear panel, a left side panel, a right side panel, a bottom panel, and a cover panel. The front panel, rear panel, left side panel, right side panel, and bottom panel are joined together to define a bag opening. The cover panel is joined to the rear panel to define a connection pocket. The flap defines first and second flap surfaces. The first connection system detachably attaches the flap to the bag assembly such that the flap may be in one of a first attached configuration, a second attached configuration, and a detached configuration. When in either of the first and second attached configurations, the flap may be moved between a closed configuration in which the flap covers the bag opening and an open configuration in which the flap does not cover the bag opening. When in the first attached configuration, the first flap surface is visible when the flap is in the closed configuration. When in the second attached configuration, the second flap surface is visible when the flap is in the closed configuration. When the flap is in either of the first or the second attached configurations, the first connection system is substantially located within the connection pocket.

The present invention may also be embodied as a flap to be detachably attached to a bag assembly, where the bag assembly comprises a first connector and defines a bag opening and a connection pocket. In this embodiment, the flap comprises a flap member and a second connector. The flap member defines first and second flap surfaces. The first connector is detachably attachable to the second connector to detachably attach the flap to the bag assembly such that the flap may be in one of a first attached configuration, a second attached configuration, and a detached configuration. When in either of the first and second attached configurations, the flap may be moved between a closed configuration in which the flap covers the bag opening and an open configuration in which the flap does not cover the bag opening. When in the first attached configuration, the first flap surface is visible when the flap is in the closed configuration. When in the second attached configuration the second flap surface is visible when the flap is in the closed configuration. When the flap is in either of the first and second attached configurations, the first and second connectors are substantially located within the connection pocket.

The present invention may also be embodied as a carrying bag assembly comprising a bag assembly, a flap, and first and second connection systems. The bag assembly comprises a front panel, a rear panel, a left side panel, a right side panel, a bottom panel, and a cover panel. The front panel, rear panel, left side panel, right side panel, and bottom panel are joined together to define a bag opening. The cover panel is joined to the rear panel to define a connection pocket. The flap defines first and second flap surfaces. The first connection system detachably attaches the flap to the bag assembly such that the flap may be in one of a first attached configuration, a second attached configuration, and a detached configuration. When in either of the first and second attached configurations, the flap may be moved between a closed configuration in which the flap covers the bag opening and an open configuration in which the flap does not cover the bag opening. When in the first attached configuration, the first flap surface is visible when the flap is in the closed configuration. When in the second attached configuration, the second flap surface is visible when the flap is in the closed configuration. When the flap is in either of the first or the second attached configurations, the first connection system is substantially located within the connection pocket. The second connection system is adapted to detachably attach the flap to the bag assembly to secure the flap in the closed configuration.

DETAILED DESCRIPTION

Figure 1:
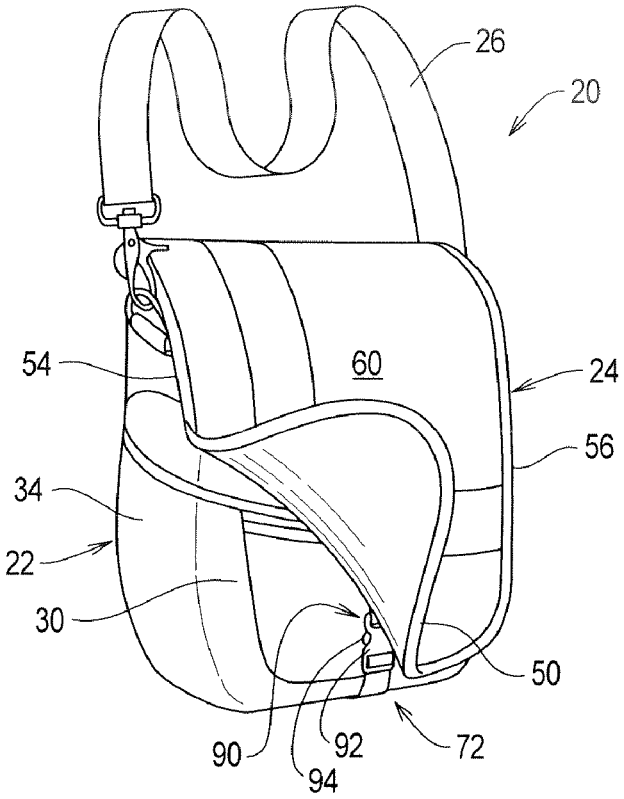
FIG. 1 is a perspective view of a first example carrying bag assembly of the present invention.

Referring initially to FIG. 1 of the drawing, depicted therein is a first example carrying bag assembly 20 constructed in accordance with, and embodying, the principles of the present invention.

The first example carrying bag assembly 20 is a messenger bag comprising a bag assembly 22, a flap 24, and a strap 26. The carrying bag assembly 20 defines a bag opening 28. The first example bag assembly 20 is thus designed to be worn by arranging the strap 26 over the wearer's shoulder such that the bag assembly 22 hangs adjacent to the wearer's side, lower back, or stomach. When worn, the flap 24 is typically arranged away from the wearer.

The principles of the present invention may also be applied to carrying bags, in addition to messenger bags, such as purses, backpacks, and computer bags that employ a bag portion and a flap such as the bag assembly 22 and the flap 24. The strap 26 is a feature of a messenger bag and is not per se part of the present invention. Other types of carrying bags may use handles or alternate configurations of straps (e.g., a pair of shoulder straps of a back pack) to facilitate carrying of the bag portion by the wearer.

Figure 2:
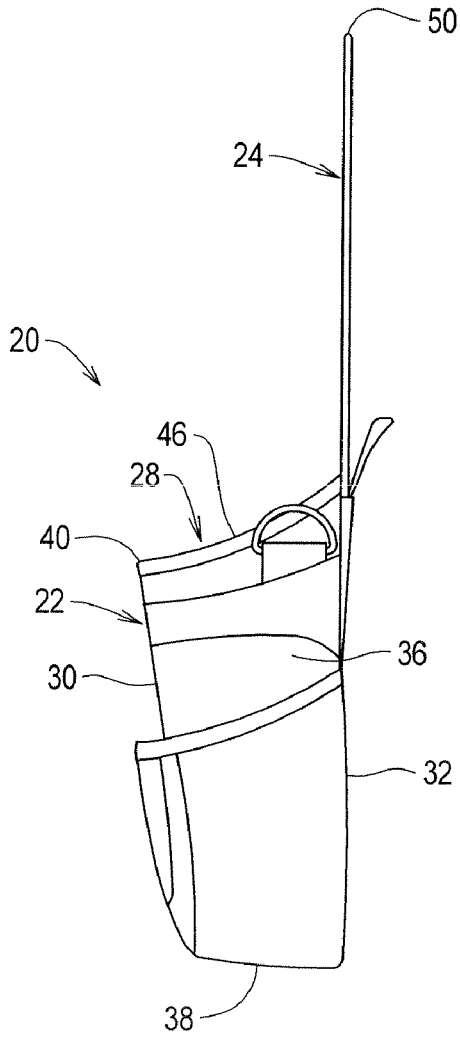
FIG. 2 is a side elevation view of the first example carrying bag assembly with a flap in an open configuration.

As shown in FIGS. 1 and 2, the bag assembly 22 defines a front panel 30, a rear panel 32, a left side panel 34, a right side panel 36, and a bottom panel 38. The bag opening 28 in the bag assembly 22 is defined by a first upper edge 40 of the front panel 30, a second upper edge 42 of the rear panel 32, a third upper edge 44 of the left side panel 34, and a fourth upper edge 46 of the right side panel 36. When worn, the front panel 30 is arranged away from and the rear panel 32 is typically arranged towards the wearer.

The panels 30, 32, 34, 36, and 38 are typically made of one or more sheets of flexible fabric. The entire example bag assembly 22 is thus flexible. The fabric sheets may be edge joined and/or may overlap to define a laminate structure with different surface characteristics. As is conventional, the panel upper edges 40, 42, 44, and 46 may be finished by stitching, banding, or the like.

The flap 24 defines a first flap edge 50, a second flap edge 52, a third flap edge 54, and a fourth flap edge 56. The flap 24 further defines a first flap surface 60 and a second flap surface 62. The flap 24 is also typically made of one or more sheets of flexible fabric. The example flap 24 is thus also flexible as generally shown in FIG. 1. The fabric sheets may be edge joined and/or may overlap to define a laminate structure with different surface characteristics. As is conventional, the flap edges 50, 52, 54, and 56 may be finished by stitching, banding, or the like.

The example flap 24 may be detachably attached to the bag assembly 22 by a first attachment system 70 and/or a second attachment system 72. The first attachment system detachably attaches the second flap edge 52 to the second upper edge 42 defined by the rear panel portion 32 of the bag assembly 22. The second attachment system 72 detachably attaches the first flap edge 50 to the front panel portion 30 of the bag assembly 22.

The first attachment system 70 thus allows the flap to be in an attached configuration (e.g., FIGS. 1, 2, 7, 8) or a detached configuration (e.g., FIGS. 3-6) relative to the bag assembly 22. In the attached configuration, the flap 24 is attached to the bag assembly 22 so that the flap 24 can be moved between a closed configuration (e.g., FIG. 1) in which the flap 24 covers the bag opening 28 and an open configuration (e.g., FIG. 2) in which the flap 24 does not cover the bag opening 28. The second attachment system 72 allows the flap 24 to be secured in the closed configuration relative to the bag assembly 22. When the flap 24 is in the closed configuration, the flap 24 defines most of the visible surface area of the carrying bag 20 and thus determines a substantial portion of the aesthetic characteristics of the carrying bag 20.

By allowing the flap 24 to be detached from the bag assembly 22, the first attachment system 70 further allows the wearer to select which of the first and second flap surfaces 60 and 62 is an outer or exposed surface that is visible when the flap 24 is in the closed configuration. The one of the flap surfaces 60 and 62 that is not the exposed surface will be referred to as an inner surface.

Figure 3:
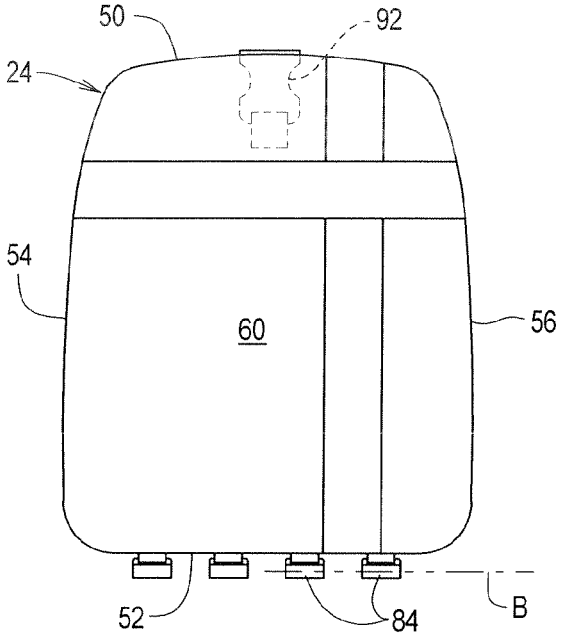
FIG. 3 is a first elevation view of the flap of the first example carrying bag assembly.
Figure 4:
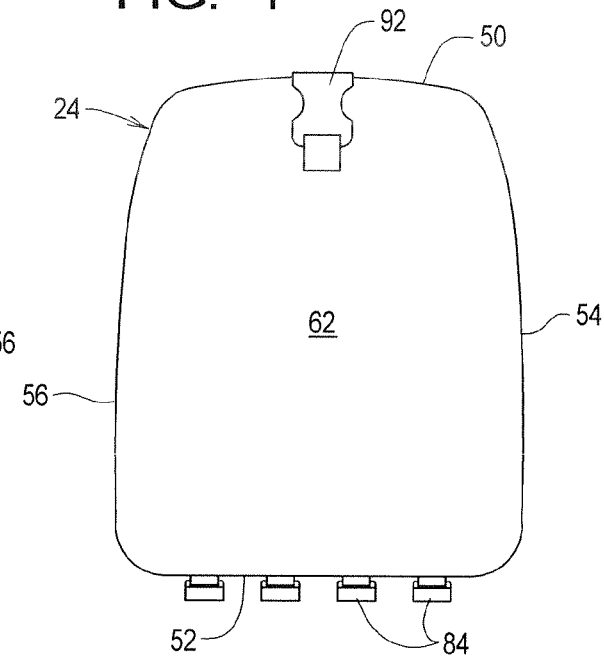
FIG. 4 is a second elevation view of the flap of the first example carrying bag assembly.
Figure 5:
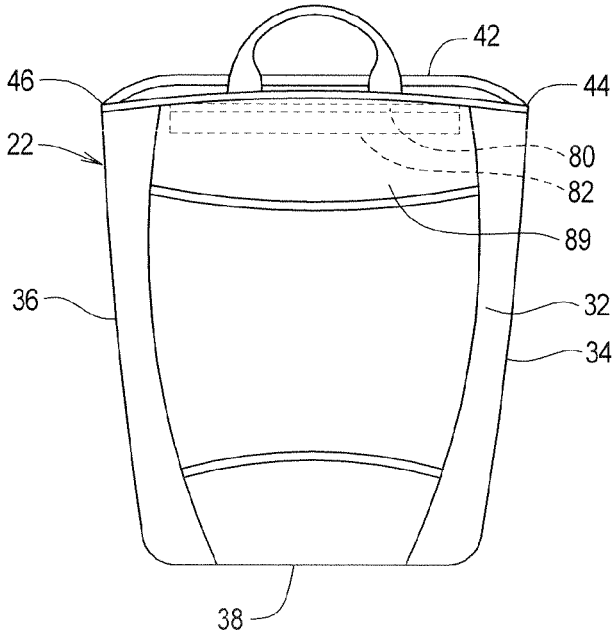
FIG. 5 is a rear elevation view of a bag portion of the first example carrying bag assembly.

As shown in FIGS. 3 and 4, the first and second flap surfaces 60 and 62 may have different aesthetic characteristics. In particular, these surfaces may be made of different materials, may have different textures formed thereon, may have different colors or combinations of colors, may have different graphics imprinted thereon, items such as pockets, beads, or the like may be sewn to one and not the other of the surfaces, and/or different items may be sewn to the two surfaces. As a representative example, the first flap surface 60 comprises two intersecting lines on a blank background, while the second flap surface 62 comprises simply a blank background.

The first attachment system 70 allows the wearer to select which of the first and second flap surfaces 60 and 62 is visible and thus to select the aesthetic characteristics of a substantial portion of the carrying bag 20.

Referring now to FIGS. 3-8, the example first attachment system 70 will be described in further detail. The example first attachment system 70 comprises a rail member 80, a rail panel 82, and one or more rail clips 84.

Figure 8:
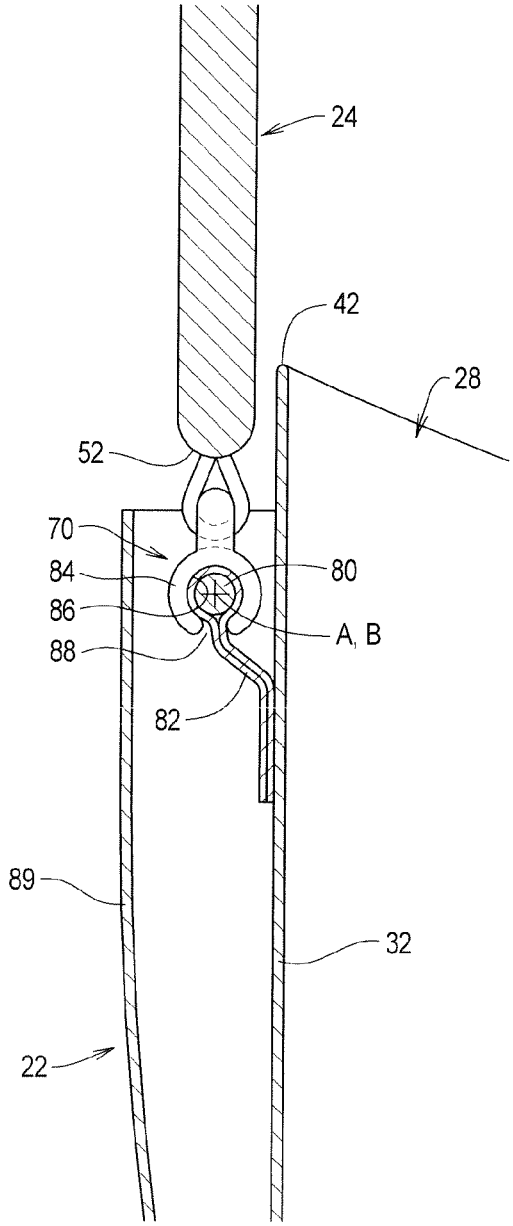
FIG. 8 is a section view of a portion of the first example carrying bag assembly taken along lines 8-8 in FIG. 7.

The rail member 80 defines a shape having a cross-sectional area as shown in FIG. 8; the example rail member 80 is generally in the shape of a cylindrical solid with a substantially circular cross-section. The example rail panel 82 is a sheet of fabric sewn to the rear panel 32. The rail panel 82 surrounds at least a portion of the rail member to secure the rail member 80 in a predetermined relationship to the second upper edge 42 of the rear panel 32. In the example first attachment system 70, the rail member 80 defines a rail axis A that is substantially parallel to and spaced slightly below the second upper edge 42.

The example first attachment system 70 comprises four of the rail clips 84. Each of the rail clips 70 defines a clip chamber 86 and a clip gap 88. The clip chambers 86 define a shape and cross-sectional area, with the example clip chambers 86 being substantially cylindrical in shape and having a cross-section that is substantially circular. The rail clips 84 are sewn at spaced locations along the second flap edge 52 of the flap 24 such that the clip openings 88 substantially align to define a clip axis B. A diameter of the clip chambers 86 is slightly larger than the diameter of the rail member 80. The clip gaps 88 define a gap distance that is slightly smaller than the diameter of the rail member 80.

Figure 6:
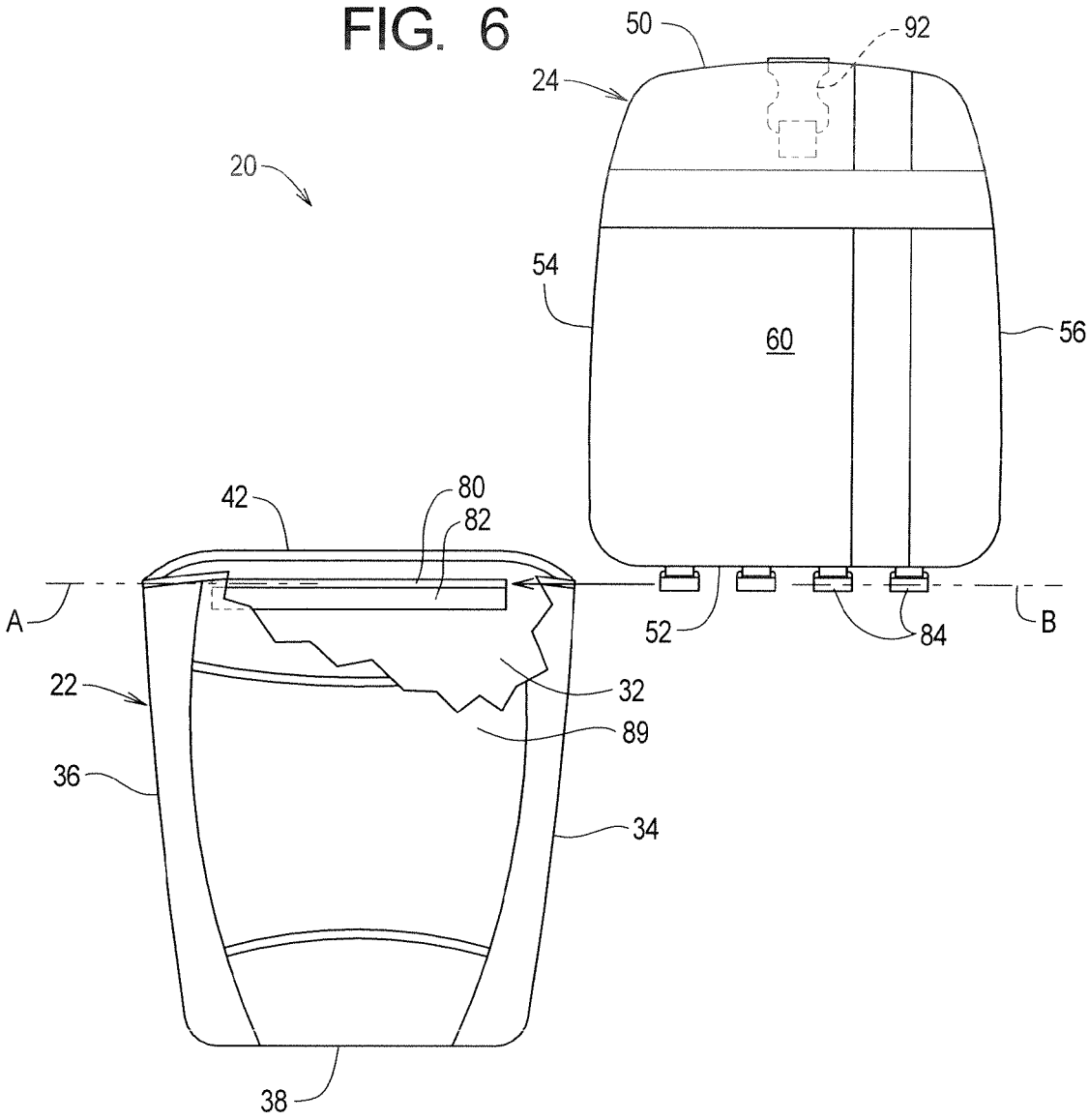
FIGS. 6 and 7 are rear elevation views illustrating the process of attaching the flap to the bag portion of the first example carrying bag assembly.
Figure 7:
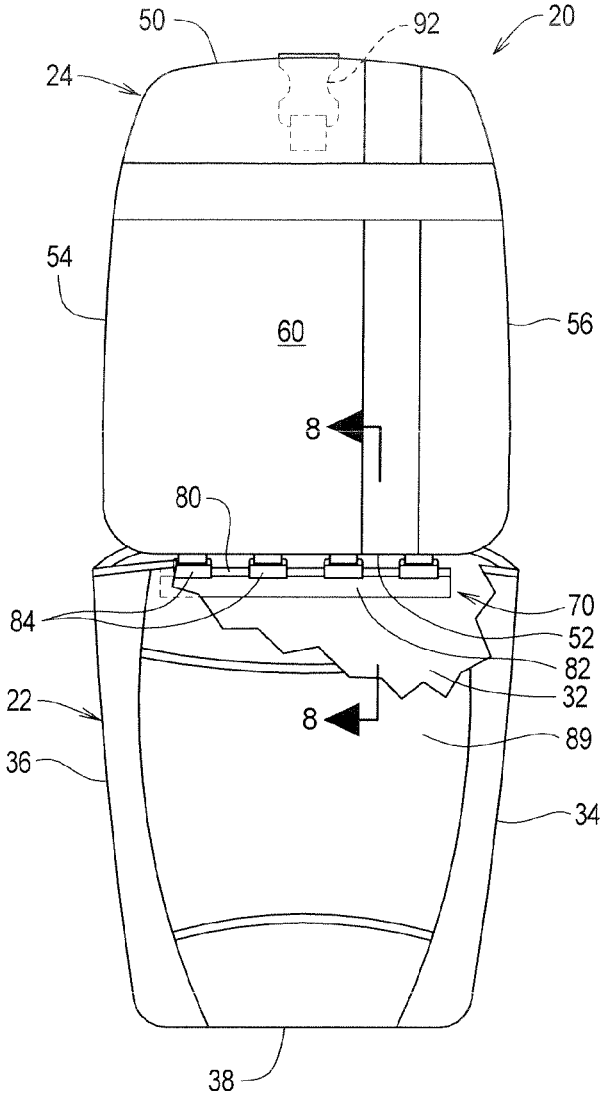

The process of attaching the flap 24 to the bag assembly 22 using the first attachment system 70 will be described with reference to FIGS. 6-8. As shown in FIG. 6, to change the flap from the detached configuration into the attached configuration, the flap 24 is displaced relative to the bag assembly 22 with the clip axis B aligned with the rail axis A such that the rail member 80 is received within the clip chambers 86. When the rail member 80 is located within the clip chambers 86 as shown in FIGS. 7 and 8, portions of the rail panel 82 extending between the rail member 80 and the rear panel 32 lie within the clip gaps 88.

Given the relative sizes of the rail member 80 and the clip gaps 88, and because the rail member 80 is surrounded by the rail panel 82, the rail member 80 is too large to be withdrawn from the clip chambers 86 through the clip gaps 88 (e.g., radially from the aligned rail axis A and clip axis B).

The first attachment system 70 is thus in the attached configuration when the rail member 80 lies within the clip chambers 86. In the attached configuration, the flexibility of the flap 24, the connection formed by the first attachment system, and the rail panel 82 allows movement of the flap 24 relative to the bag assembly 22 between its open and closed configurations.

To remove the flap 24 from the bag assembly 22, the flap 24 is displaced relative to the bag assembly 22 such that the rail clips 84 move along the rail axis A such that the rail member 80 is no longer received within the clip chambers 86. When the rail member 80 is no longer received by any of the clip chambers 86, the flap 24 is in its detached configuration.

As an alternative, the rail clips 84 may be made sufficiently rigid to prevent inadvertent withdrawal of the rail member 80 through the clip gaps 88, but sufficiently deformable to allow the rail member 80 to be pressed through the clip gaps 88. In this case, the flap 24 may be placed into the attached configuration by pressing the rail member 80 through the clip gaps 88 using deliberate application of manual force to deform the rail clips 84 such that the rail member 80 may enter the clip chambers 86. Deliberate application of manual force may also be used to place the flap in the detached configuration by displacing the rail member 80 relative to the rail clips 84 to deform the rail clips and allow the rail member 80 to pass through the clip gaps 88.

A cover panel 89 is secured to and substantially covers the rear panel 32. As shown in FIG. 8, the first fastening system 70 is hidden behind the cover panel 89 when the flap 24 is in the attached configuration.

The second attachment system 72 may be any attachment system capable of maintaining the flap 24 in its closed configuration during normal use but which allows the flap 24 easily to be placed in its open configuration when access to the bag opening 28 is desired. The example second attachment system 72 comprises clip assembly 90 comprising a female clip portion 92 and a male clip portion 94. The female clip portion 92 is attached to the flap 24, while the male clip portion 94 is attached to the bag assembly 22 such that the male clip portion 94 is adjacent to a juncture between the front panel 30 and bottom panel 38. The clip assembly 90 is or may be conventional. Other possible second attachment systems include one or more snap fasteners, hook and loop fasteners, and the like.

Referring now to FIGS. 9-14 of the drawing, depicted therein is a second example carrying bag assembly 120 constructed in accordance with, and embodying, the principles of the present invention.

The second example carrying bag assembly 120 is a messenger bag comprising a bag assembly 122, a flap 124, and a strap (not shown). The carrying bag assembly 120 defines a bag opening 128. The second example bag assembly 120 is thus designed to be worn by arranging the strap over the wearer's shoulder such that the bag assembly 122 hangs adjacent to the wearer's side, lower back, or stomach. When worn, the flap 124 is typically arranged away from the wearer.

The principles of the present invention may also be applied to carrying bags, in addition to messenger bags, such as purses, backpacks, and computer bags that employ a bag portion and a flap such as the bag assembly 122 and the flap 124. A strap is optional and, if used, is a feature of a messenger bag and is not per se part of the present invention. Other types of carrying bags may use handles or alternate configurations of straps (e.g., a pair of shoulder straps of a back pack) to facilitate carrying of the bag portion by the wearer.

Like the bag assembly 22 described above, the bag assembly 122 defines a front panel 130, a rear panel 132, a left side panel 134, a right side panel 136, and a bottom panel 138. The bag opening 128 in the bag assembly 122 is defined by a first upper edge 140 of the front panel 130, a second upper edge 142 of the rear panel 132, a third upper edge 144 of the left side panel 134, and a fourth upper edge 146 of the right side panel 136. When worn, the front panel 130 is arranged away from the wearer, and the rear panel 132 is typically arranged towards the wearer.

The panels 130, 132, 134, 136, and 138 are typically made of one or more sheets of flexible fabric. The entire example bag assembly 122 is thus flexible. The fabric sheets may be edge joined and/or may overlap to define a laminate structure with different surface characteristics. As is conventional, the panel upper edges 140, 142, 144, and 146 may be finished by stitching, banding, or the like.

The flap 124 defines a first, or distal, flap edge 150, a second, or proximal, flap edge 152, a third, or first side, flap edge 154, and a fourth, or second side, flap edge 156. The flap 124 further defines a first flap surface 160 and a second flap surface 162. The flap 124 is also typically made of one or more sheets of flexible fabric. The example flap 124 is thus also flexible as generally shown in FIG. 1. The fabric sheets may be edge joined and/or may overlap to define a laminate structure with different surface characteristics. As is conventional, the flap edges 150, 152, 154, and 156 may be finished by stitching, banding, or the like.

Figure 9:
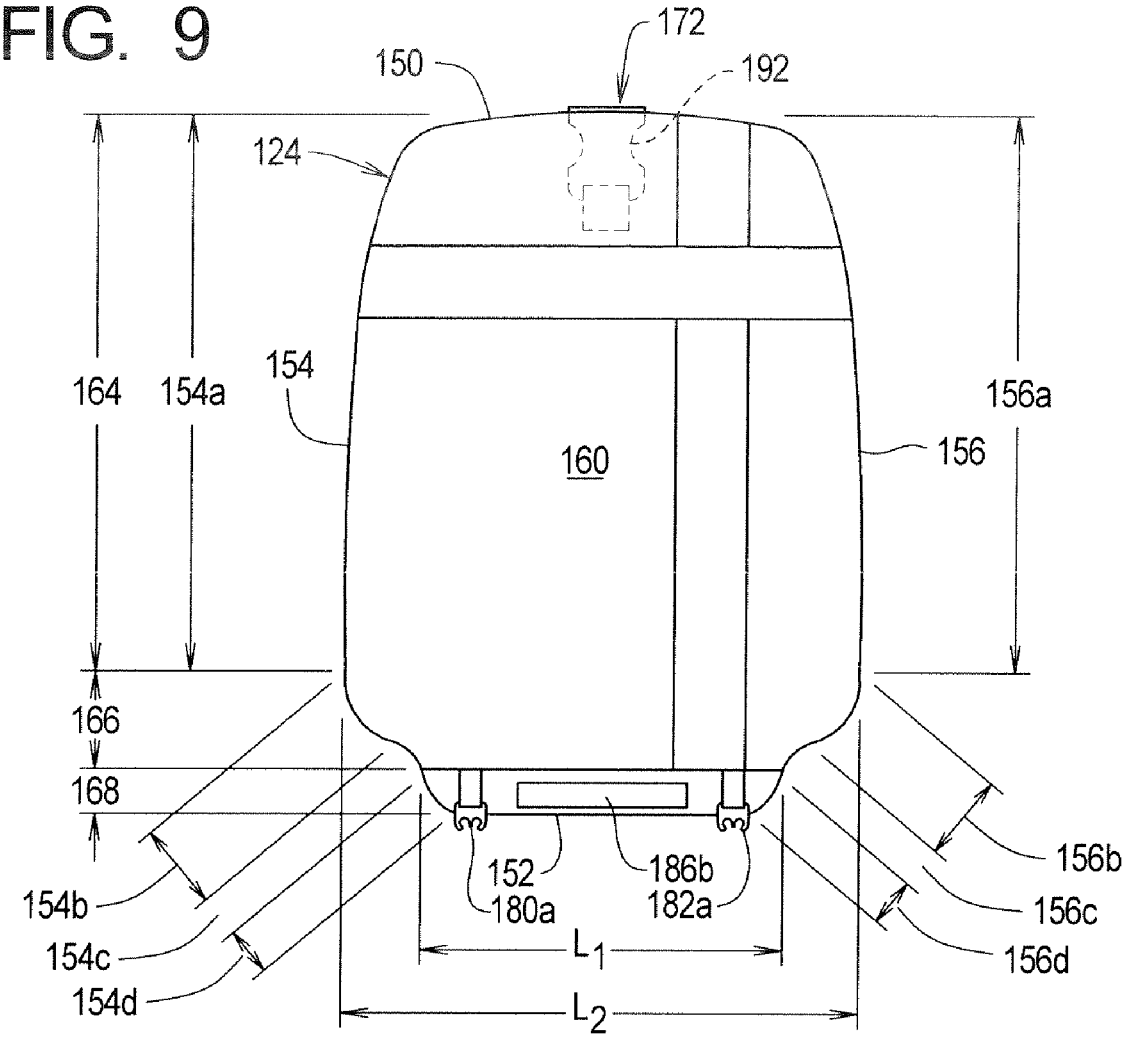
FIG. 9 is a first elevation view of the flap of a second example carrying bag assembly.
Figure 10:
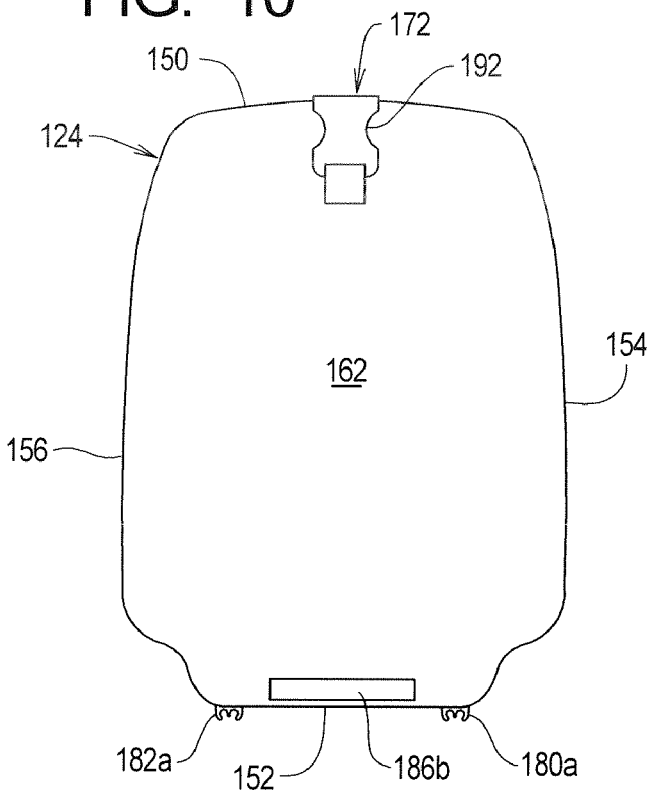
FIG. 10 is a second elevation view of the flap of the second example carrying bag assembly.
Figure 11:
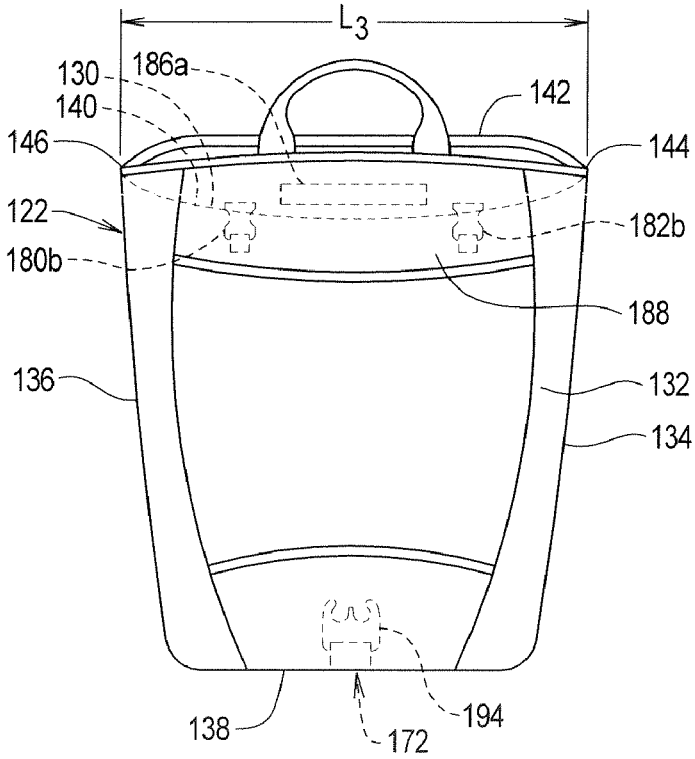
FIG. 11 is a rear elevation view of a bag portion of the second example carrying bag assembly.

With reference to FIGS. 9 and 10, it can be seen that the flap 124 comprises a first, or exposed, portion 164, a second, or transition, portion 166, and a third, or connecting, portion 168. The first and second side edges 154 and 156 each comprise main portions 154*a* and 156*a*, first portions 154*b* and 156*b*, second portions 154*c* and 156*c*, and third portions 154*d* and 156*d*. The example main portions 154*a* and 156*a* are substantially straight. The example first and third portions 154*b,d* and 156*b,d* are outwardly curved or convex. The example second portions 154*c* and 156*c* are inwardly curved or concave.

The example portions 154*b,c,d* and 156*b,c,d* are arranged between the main portions 154*a* and 156*a* and the proximal flap edge 152. The example main portions 154*a* and 156*a* are, together with the distal edge 150, substantially border the exposed portion 164 of the flap 124. The first and second portions 154*b,c* and 156*b,c* substantially border the transition portion 166 of the flap 124. The third portions 154*d* and 156*d* and the proximal edge 152 substantially border the connecting portion 168 of the flap 124.

In the example flap 124, the connecting portion 168 defines a lateral dimension L1 that is smaller than a lateral dimension L2 defined by the main portion 164. The flap 124 thus narrows in lateral width from the lateral dimension L2 to the lateral dimension L1 through the transition portion 166.

The example flap 124 may be detachably attached to the bag assembly 122 by a first attachment system 170 and/or a second attachment system 172. The first attachment system 170 detachably attaches the second flap edge 152 to the second upper edge 142 defined by the rear panel portion 132 of the bag assembly 122. The second attachment system 172 detachably attaches the first flap edge 150 to the front panel portion 130 of the bag assembly 122.

The first attachment system 170 thus allows the flap to be in an attached configuration (e.g., FIGS. 13 and 14) or a detached configuration (e.g., FIGS. 9-12) relative to the bag assembly 122. In the attached configuration, the flap 124 is attached to the bag assembly 122 so that the flap 124 can be moved between a closed configuration in which the flap 124 covers the bag opening 128 and an open configuration in which the flap 124 does not cover the bag opening 128. The second attachment system 172 allows the flap 124 to be secured in the closed configuration relative to the bag assembly 122. When the flap 124 is in the closed configuration, the flap 124 defines most of the visible surface area of the carrying bag 120 and thus determines a substantial portion of the aesthetic characteristics of the carrying bag 120.

By allowing the flap 124 to be detached from the bag assembly 122, the first attachment system 170 further allows the wearer to select which of the first and second flap surfaces 160 and 162 is an outer or exposed surface that is visible when the flap 124 is in the closed configuration. The one of the flap surfaces 160 and 162 that is not the exposed surface will be referred to as an inner surface.

As shown in FIGS. 9 and 10, the first and second flap surfaces 160 and 162 may have different aesthetic characteristics. In particular, these surfaces may be made of different materials, may have different textures formed thereon, may have different colors or combinations of colors, may have different graphics imprinted thereon, items such as pockets, beads, or the like may be sewn to one and not the other of the surfaces, and/or different items may be sewn to the two surfaces. Like the example flap surfaces 60 and 62 describe above, the first flap surface 160 comprises two intersecting lines on a blank background, while the second flap surface 162 comprises simply a blank background.

The first attachment system 170 allows the wearer to select which of the first and second flap surfaces 160 and 162 is visible and thus to select the aesthetic characteristics of a substantial portion of the carrying bag 120.

The example first attachment system 170 will be now described in further detail. The example first attachment system 170 comprises first and second clip systems 180 and 182 and a hook and loop fastener system 184. The clip systems 180 and 182 are or may be conventional, and the example clip systems 180 and 182 each comprise a male clip portion 180*a* and 182*a* and a female clip portion 180*b* and 182*b*. The male clip portions 180*a* and 182*a* are attached to the connecting portion 168 of the flap 124, while the female clip portions 180*b* and 182*b* are attached to the bag assembly 122 such that the female clip portions 180*b* and 182*b* are adjacent to the upper edge 142 of the rear panel 132. Other possible second attachment systems include one or more snap fasteners, hook and loop fasteners, and the like The hook and loop fastener system 184 comprises a hook panel 186*a* and a loop panel 186*b*. One of the hook panel 186*a* and the loop panel 186*b* is sewn to the connecting portion 168 of the flap 124, while the other of the hook panel 186*a* and the loop panel 186*b* is sewn to a cover panel 188 that is secured relative to and covers at least a portion of the rear panel 132. As perhaps best shown in FIG. 14, the cover panel 188 and the rear panel 132 define a connection pocket 188*a*. A lateral dimension L3 of the connection pocket 188*a* is substantially the same as the lateral dimension L1 of the connecting portion 168.

When the flap 124 is in its attached configuration, the clip systems 180 and 182 are engaged and the hook panel 186*a* engages the loop panel 186*b* to secure the flap 124 to the bag assembly 122. The clip systems 180 and 182 and the hook and loop fastening system 184 are hidden behind the cover panel 188 within the connection pocket 188*a*. Also, when the flap 124 is in the attached configuration, the connecting portion 168 of the flap 124 is substantially hidden by the cover panel 188 within the connection pocket 188*a*. The transition portion 166 of the flap 124 extends over the bag opening 128, and the exposed portion 164 of the flap 124 extends along the front panel 130. Colors, graphics, and/or other aesthetic features of the flap 124 are formed on the front or back flap surfaces 160 and 162, typically within the exposed and transition portions 164 and 166 thereof.

Figure 12:
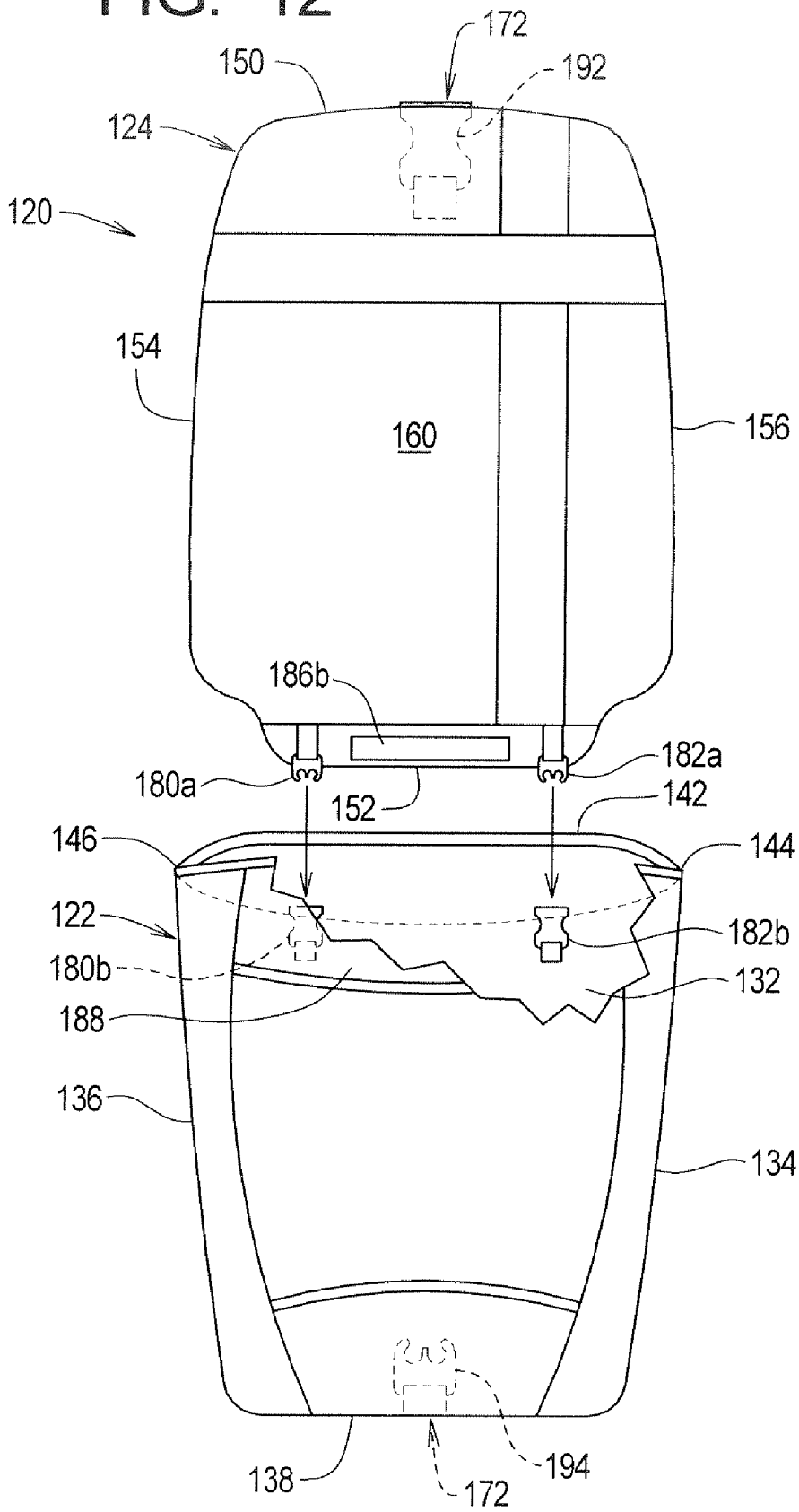
FIGS. 12 and 13 are rear elevation views illustrating the process of attaching the flap to the bag portion of the second example carrying bag assembly.
Figure 13:
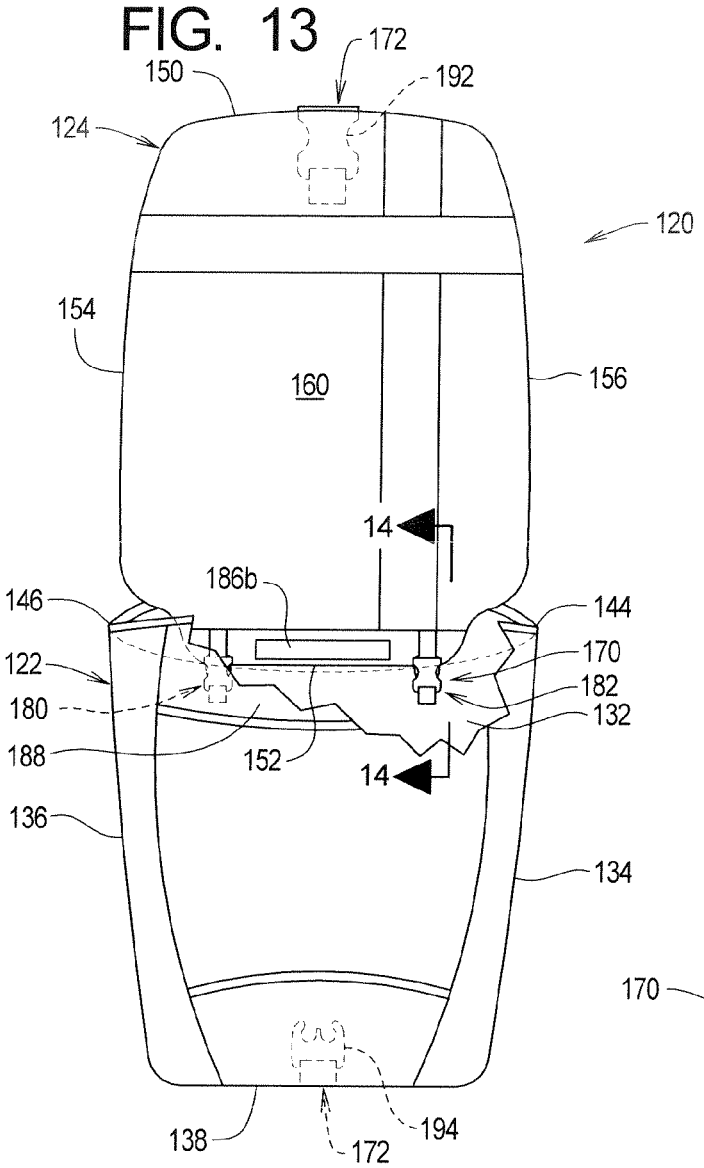
Figure 14:
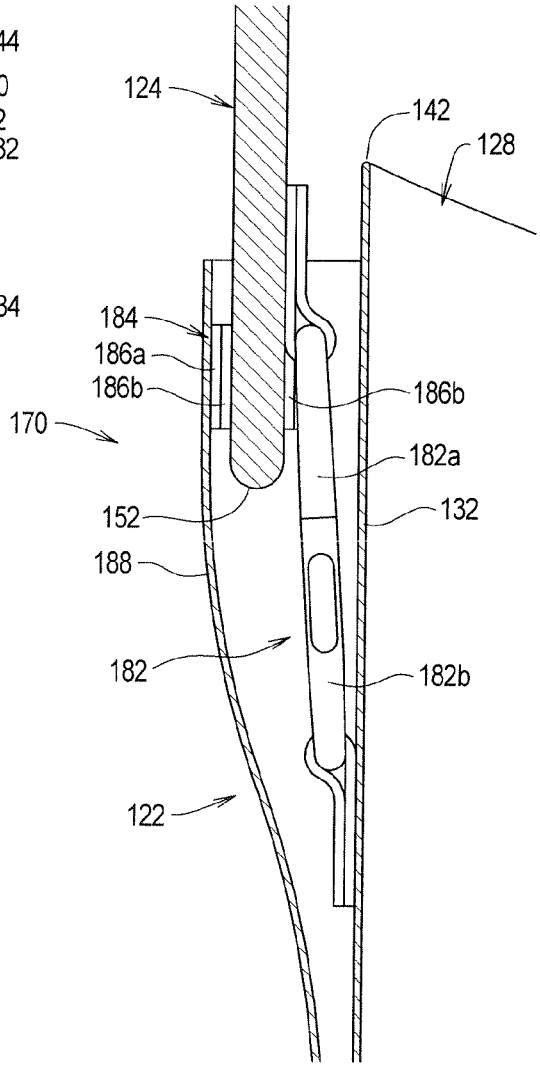
FIG. 14 is a section view of a portion of the second example carrying bag assembly taken along lines 14-14 in FIG. 13.

The process of attaching the flap 124 to the bag assembly 122 using the first attachment system 170 will be described with reference to FIGS. 12 and 13. As shown in FIG. 12, to change the flap from the detached configuration into the attached configuration, the flap 124 is displaced relative to the bag assembly 122 such that the connection portion 168 of the flap 124 enters the connection pocket 188*a*, at which time the clip systems 180 and 182 are engaged. The flap 124 is further forced against the cover panel 188 to cause the hook panel 186*a* to engage the loop panel 186*b*. The narrowing of the flap 124 in lateral width described above facilitates insertion of the connection portion 168 of the flap into the connection pocket 188*a* and also the formation of the first and second connection systems 170 and second fastener system 184.

The first attachment system 170 is thus in the attached configuration when the clip systems 180 and 182 are engaged and/or the hook and loop fastening system is formed. In the attached configuration, the flexibility of the flap 124, the connection formed by the first attachment system 170, and the flexibility of the cover panel 188 allow movement of the flap 124 relative to the bag assembly 122 between its open and closed configurations.

To remove the flap 124 from the bag assembly 122, the hook panel 186*a* is detached from the loop panel 186*b* and the clip systems 180 and 182 are disengaged. The flap 124 is then in its detached configuration and may be displaced away from the bag assembly 122.

The second attachment system 172 may be any attachment system capable of maintaining the flap 124 in its closed configuration during normal use but which allows the flap 124 easily to be placed in its open configuration when access to the bag opening 128 is desired. Like the example second attachment system 72 described above, the example second attachment system 172 comprises clip assembly 190 comprising a female clip portion 192 and a male clip portion 194. The female clip portion 192 is attached to the flap 124, while the male clip portion 194 is attached to the bag assembly 122 such that the male clip portion 194 is adjacent to a juncture between the front panel 130 and bottom panel 138. The clip assembly 190 is or may be conventional. Other possible second attachment systems include one or more snap fasteners, hook and loop fasteners, and the like.

Given the foregoing, it should be apparent that the present invention may be embodied in forms other than those described above. The scope of the present invention should thus be determined by the claims appended hereto and not the foregoing detailed description of several examples of the present invention.

What is claimed is:

1. A carrying bag assembly comprising:

a bag assembly comprising a front panel, a rear panel, a left side panel, a right side panel, a bottom panel, and a cover panel, where the front panel, rear panel, left side panel, right side panel, and bottom panel are joined together to define a bag opening, and the cover panel is joined to the rear panel to define a connection pocket;

a flap defining first and second flap surfaces; and a first connection system, where the first connection system detachably attaches the flap to the bag assembly such that the flap may be in one of a first attached configuration, a second attached configuration, and a detached configuration, and when in either of the first and second attached configurations, the flap may be moved between a closed configuration in which the flap covers the bag opening and an open configuration in which the flap does not cover the bag opening; wherein when in the first attached configuration, the first flap surface is visible when the flap is in the closed configuration;

when in the second attached configuration, the second flap surface is visible when the flap is in the closed configuration; and when the flap is in either of the first or the second attached configurations, the first connection system is substantially located within the connection pocket.

2. A carrying bag assembly as recited in claim 1, further comprising a second connection system for detachably attaching the flap to the bag assembly to secure the flap in the closed configuration.

3. A carrying bag assembly as recited in claim 1, in which the first connection system comprises a first portion and a second portion, where:

the first and second portions may be detachably attached to each other;

the first portion is secured to the bag assembly within the connection pocket; and the second portion is secured to the flap.

4. A carrying bag assembly as recited in claim 1, in which the first connection system comprises at least one buckle assembly comprising a first portion and a second portion, where:

the first portion is secured to the bag assembly within the connection pocket; and the second portion is secured to the flap.

5. A carrying bag assembly as recited in claim 1, in which the first connection system comprises at least one hook and loop assembly comprising a first portion and a second portion, where:

the first portion is secured to the bag assembly within the connection pocket; and the second portion is secured to the flap.

6. A carrying bag assembly as recited in claim 1, in which the first connection system comprises:

at least one buckle assembly comprising a male portion and a female portion, where one of the male portion and the female portion is secured to the bag assembly within the connection pocket and the other of the male portion and the female portion is secured to the flap, and at least one hook and loop assembly comprising a hook portion and a loop portion, where at least one of the hook portion and the loop portion is secured to the bag assembly within the connection pocket and the other of the hook portion and the loop portion is secured to the flap.

7. A carrying bag assembly as recited in claim 1, in which the first connection system comprises:

first and second buckle assemblies each comprising a male portion and a female portion, where one of the male portion and the female portion is secured to the bag assembly within the connection pocket and the other of the male portion and the female portion is secured to the flap; and at least one hook and loop assembly comprising a hook portion and a loop portion, where at least one of the hook portion and the loop portion is secured to the bag assembly within the connection pocket and the other of the hook portion and the loop portion is secured to the flap; wherein the hook and loop assembly is arranged between the first and second buckle assemblies.

8. A carrying bag assembly as recited in claim 1, in which the first connection system comprises:

at least one buckle assembly comprising a male portion and a female portion, where one of the male portion and the female portion is secured to the rear panel of the bag assembly within the connection pocket and the other of the male portion and the female portion is secured to the flap; and at least one hook and loop assembly comprising a hook portion and a loop portion, where at least one of the hook portion and the loop portion is secured to the cover panel of the bag assembly within the connection pocket and the other of the hook portion and the loop portion is secured to the flap.

9. A flap to be detachably attached to a bag assembly, where the bag assembly comprises a first connector and defines a bag opening and a connection pocket, the flap comprising:

a flap member defining first and second flap surfaces; and a second connector; wherein the first connector is detachably attachable to the second connector to detachably attach the flap to the bag assembly such that the flap may be in one of a first attached configuration, a second attached configuration, and a detached configuration;

when in either of the first and second attached configurations, the flap may be moved between a closed configuration in which the flap covers the bag opening and an open configuration in which the flap does not cover the bag opening;

when in the first attached configuration, the first flap surface is visible when the flap is in the closed configuration;

when in the second attached configuration, the second flap surface is visible when the flap is in the closed configuration; and when the flap is in either of the first and second attached configurations, the first connection system is substantially located within the connection pocket.

10. A flap as recited in claim 9, further comprising a flap securing system for detachably attaching the flap to the bag assembly to secure the flap in the closed configuration.

11. A flap as recited in claim 9, in which:

the first connector is secured to the bag assembly within the connection pocket; and the second connector is secured to the flap.

12. A carrying bag assembly as recited in claim 9, in which the first and second connectors form a hook and loop assembly comprising a first portion and a second portion, where:

the first portion is secured to the bag assembly within the connection pocket; and the second portion is secured to the flap.

13. A flap as recited in claim 9, in which:

the first and second connectors form a buckle assembly comprising a male portion and a female portion, where one of the male portion and the female portion forms the first connector that is secured to the bag assembly within the connection pocket and the other of the male portion and the female portion forms the second connector that is secured to the flap; and the flap further comprises a hook and loop assembly comprising a hook portion and a loop portion, where at least one of the hook portion and the loop portion is secured to the bag assembly within the connection pocket and the other of the hook portion and the loop portion is secured to the flap.

14. A flap as recited in claim 9, in which:

the first and second connectors form a buckle assembly comprising a male portion and a female portion, where one of the male portion and the female portion is secured to the rear panel of the bag assembly within the connection pocket and the other of the male portion and the female portion is secured to the flap; and the flap further comprises a hook and loop assembly comprising a hook portion and a loop portion, where at least one of the hook portion and the loop portion is secured to the cover panel of the bag assembly within the connection pocket and the other of the hook portion and the loop portion is secured to the flap.

15. A flap as recited in claim 9, in which the flap defines:

a main portion defining a first lateral dimension;

a transition portion; and a connecting portion defining a second lateral dimension; wherein the second lateral dimension is smaller than the first lateral dimension.

16. A flap as recited in claim 9, in which the connection pocket defines a third lateral dimension, where the third lateral dimension is larger than the second lateral dimension.

17. A flap as recited in claim 16, in which the connection pocket defines a third lateral dimension, where the third lateral dimension is substantially the same as the first lateral dimension.

18. A carrying bag assembly comprising:

a bag assembly comprising a front panel, a rear panel, a left side panel, a right side panel, a bottom panel, and a cover panel, where the front panel, rear panel, left side panel, right side panel, and bottom panel are joined together to define a bag opening, and the cover panel is joined to the rear panel to define a connection pocket;

a flap defining first and second flap surfaces;

a first connection system; and a second connection system; wherein the first connection system detachably attaches the flap to the bag assembly such that the flap may be in one of a first attached configuration, a second attached configuration, and a detached configuration;

when in either of the first and second attached configurations, the flap may be moved between a closed configuration in which the flap covers the bag opening and an open configuration in which the flap does not cover the bag opening;

when in the first attached configuration, the first flap surface is visible when the flap is in the closed configuration;

when in the second attached configuration, the second flap surface is visible when the flap is in the closed configuration;

when the flap is in either of the first or the second attached configurations, the first connection system is substantially located within the connection pocket; and the second connection system is adapted to detachably attach the flap to the bag assembly to secure the flap in the closed configuration.

19. A carrying bag assembly as recited in claim 18, in which the first connection system comprises a first portion and a second portion, where:

the first and second portions may be detachably attached to each other;

the first portion is secured to the bag assembly within the connection pocket; and the second portion is secured to the flap.

20. A carrying bag assembly as recited in claim 18, in which: the flap defines a main portion defining a first lateral dimension;

a transition portion; and a connecting portion defining a second lateral dimension; wherein the second lateral dimension is smaller than the first lateral dimension; and the connection pocket defines a third lateral dimension, where the second lateral dimension is smaller than the third lateral dimension.

* * * * *